US007766634B2

(12) United States Patent
Liavas et al.

(10) Patent No.: US 7,766,634 B2
(45) Date of Patent: Aug. 3, 2010

(54) CRESCENT GEAR PUMP WITH NOVEL ROTOR SET

(75) Inventors: Vasilios B. Liavas, Toronto (CA); Michal Nemec, Thornhill (CA)

(73) Assignee: Magna Powertrain Inc., Concord, Ontario (CA)

( * ) Notice: Subject to any disclaimer, the term of this patent is extended or adjusted under 35 U.S.C. 154(b) by 565 days.

(21) Appl. No.: 11/814,953

(22) PCT Filed: Feb. 16, 2006

(86) PCT No.: PCT/CA2006/000239

§ 371 (c)(1),
(2), (4) Date: Jul. 27, 2007

(87) PCT Pub. No.: WO2006/086887

PCT Pub. Date: Aug. 24, 2006

(65) Prior Publication Data

US 2008/0187450 A1 Aug. 7, 2008

(51) Int. Cl.
*F01C 1/10* (2006.01)
*F04C 2/10* (2006.01)
*F04C 18/10* (2006.01)

(52) U.S. Cl. ..... 418/170; 418/150; 74/462

(58) Field of Classification Search ..... 418/170, 418/169, 150; 74/462
See application file for complete search history.

(56) References Cited

U.S. PATENT DOCUMENTS 3,619,093 A * 11/1971 Harle et al. ..... 418/171
3,782,040 A 1/1974 Haile H. at al.
3,907,470 A 9/1975 Harle H. et al.
3,946,621 A * 3/1976 Rouverol ..... 74/462
3,982,445 A * 9/1976 Rouverol ..... 74/462
4,155,686 A 5/1979 Eisenmann et al.
4,432,712 A 2/1984 Eisenmann
4,922,781 A * 5/1990 Peiji ..... 418/171
5,163,826 A 11/1992 Cozens
5,368,455 A * 11/1994 Eisenmann ..... 418/150
5,605,451 A * 2/1997 Saitoh ..... 418/150
6,077,059 A 6/2000 Hosono
6,402,488 B2 6/2002 Watanabe et al.
6,715,847 B2 4/2004 Yamaguchi et al.
7,407,373 B2 * 8/2008 Ogata et al. ..... 418/171
2004/0022660 A1 2/2004 Eisenmann
2004/0191101 A1 9/2004 Ogata et al.

FOREIGN PATENT DOCUMENTS

CH 644188 A5 7/1984
JP 59-131787 A 7/1984
WO WO 2005/005835 1/2005

* cited by examiner

*Primary Examiner*—Thomas E Denion
*Assistant Examiner*—Mary A Davis
(74) *Attorney, Agent, or Firm*—Clark Hill PLC

(57) ABSTRACT

A novel crescent gear pump and pump rotor set for a crescent gear pump. The rotor set includes an outer rotor with teeth having a composite profile formed over the portion adjacent their root to conform to a circular arc and formed over the portion adjacent their tip to conform to a hypocycloid arc. The unique shape allows for increased volumetric capacity of the rotor set, when compared to trochoidal rotor sets of the same size. Further, operating noise is reduced, as are pulsations in the output of the pump when compared to the same pump with a trochoidal rotor set.

14 Claims, 3 Drawing Sheets

CRESCENT GEAR PUMP WITH NOVEL ROTOR SET

FIELD OF THE INVENTION

The present invention relates to crescent gear pumps. More specifically, the present invention relates to a crescent gear pump with a novel rotor set.

BACKGROUND OF THE INVENTION

Crescent gear pumps are well known and have an outer rotor which is internally toothed and an inner rotor which is externally toothed. The outer rotor has a number of teeth and the inner rotor has fewer teeth, according to known design considerations. The inner and outer rotors are rotatably mounted in a pump housing having an inlet and an outlet and the axes of rotation of the rotors are spaced from one another, with their teeth meshing in a region between the inlet and outlet of the pump housing. A crescent-shaped member is located between the two rotors, opposite where the teeth mesh, and the tips of the teeth of the inner rotor sealingly engage the inner surface of the crescent and the tips of the teeth of the outer rotor sealingly engage the outer surface of the crescent as the rotors rotate to separate the inlet and outlet of the housing to allow the pump to pressurize the working fluid.

The design of the rotor set (i.e.—the inner and outer rotors), and in particular the shape of the gear teeth, for a crescent gear pump is important to ensure proper operation of the pump. Poorly designed rotor sets can suffer from poor and/or inefficient performance, operating noise, output pulsations and other problems. Further, the design of the rotor set must consider the manufacturability of the rotor set.

Previous attempts to provide rotor sets for gear pumps with desired properties have included U.S. Pat. No. 3,907,470 to Harle et al. which teaches forming the teeth of the outer rotor in a substantially trochoidal (i.e.—either completely circular-based or partially hypocycloidal-based) shape and generating the inner rotor. U.S. Pat. No. 4,155,686 to Eisenmann et al. teaches an improvement to the teaching of Harle et al. wherein the profile of the teeth of the generated inner rotor are cut-back from their generated shape to limit the contact areas of the meshing between the teeth of the rotors.

The benefits of using a substantially trochoidal tooth profile include improvements to both noise and displacement. A substantially trochoidal tooth profile enables the number of outer rotor teeth to be smaller than other designs and this results in the tooth gaps of the outer rotor being relatively large. This also results in the corresponding fluid pumping chambers formed between the teeth of the inner and outer rotors and the crescent being large and thus the resulting pumps have a correspondingly large displacement (volumetric capacity). Further, using a substantially trochoidal tooth profile provides a low tooth contact frequency translating into a low frequency operating noise for the pump.

More recently, U.S. Pat. No. 5,163,826 teaches a rotor set for a gear pump wherein the teeth of both the inner and the outer rotors have dual cycloidal profiles formed from epicycloidal and hypocycloidal arcs. This design allows for the rotor set to have an increased displacement in comparison to outer rotor-only trochoidal designs.

While the rotor set designs of the prior art provide reasonable performance, they still suffer from higher levels of operating noise than is desired. Further, the displacement of pumps of a given physical size (i.e. "package size") employing such rotor sets is less than is desired.

SUMMARY OF THE INVENTION

It is an object of the present invention to provide a novel crescent gear pump and rotor set for a crescent gear pump which obviates or mitigates at least one disadvantage of the prior art.

According to a first aspect of the present invention, there is provided a crescent gear pump, comprising: a housing defining a rotor chamber, the housing including a working fluid inlet and a working fluid outlet, each in fluid communication with a portion of the rotor chamber; a rotor set rotatable within the rotor chamber, the rotor set comprising: an outer rotor having a first number of inwardly extending teeth, each outer rotor tooth having a composite profile which includes a portion adjacent the root of the tooth formed to conform to a circular arc and a portion adjacent the tip of the tooth to conform to a hypocycloid arc; an inner rotor having a second number of outwardly extending teeth, the second number being at least two less than the first number, the teeth of the inner rotor having a conjugate composite profile of the teeth of the outer rotor; and a crescent inserted between the inner and outer rotors of the rotor set and providing a sealing surface between the teeth thereof to separate the working fluid inlet and working fluid outlet in the rotor chamber.

According to another aspect of the present invention, there is provided a rotor set for a crescent gear pump, the rotor set comprising: an outer rotor having a first number of inwardly extending teeth, each outer rotor tooth having a composite profile which includes a portion adjacent the root of the tooth formed to conform to a circular arc and a portion adjacent the tip of the tooth to conform to a hypocycloid arc; and an inner rotor having a second number of outwardly extending teeth, the second number being at least two less than the first number, the teeth of the inner rotor having a conjugate composite profile to the teeth of the outer rotor.

The present invention provides a novel crescent gear pump and a rotor set for a crescent gear pump. The pump and rotor set include an outer rotor with teeth having a composite profile formed over the portion adjacent their root by a circular arc and formed over the portion adjacent their tip by a hypocycloid arc and an inner rotor with teeth that have a conjugate composite profile of the teeth of the outer rotor. The unique shape allows for increased volumetric capacity of the rotor set, when compared to trochoidal rotor sets of the same size. Further, operating noise is reduced, as are pulsations in the output of the pump when compared to the same pump with a trochoidal rotor set.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
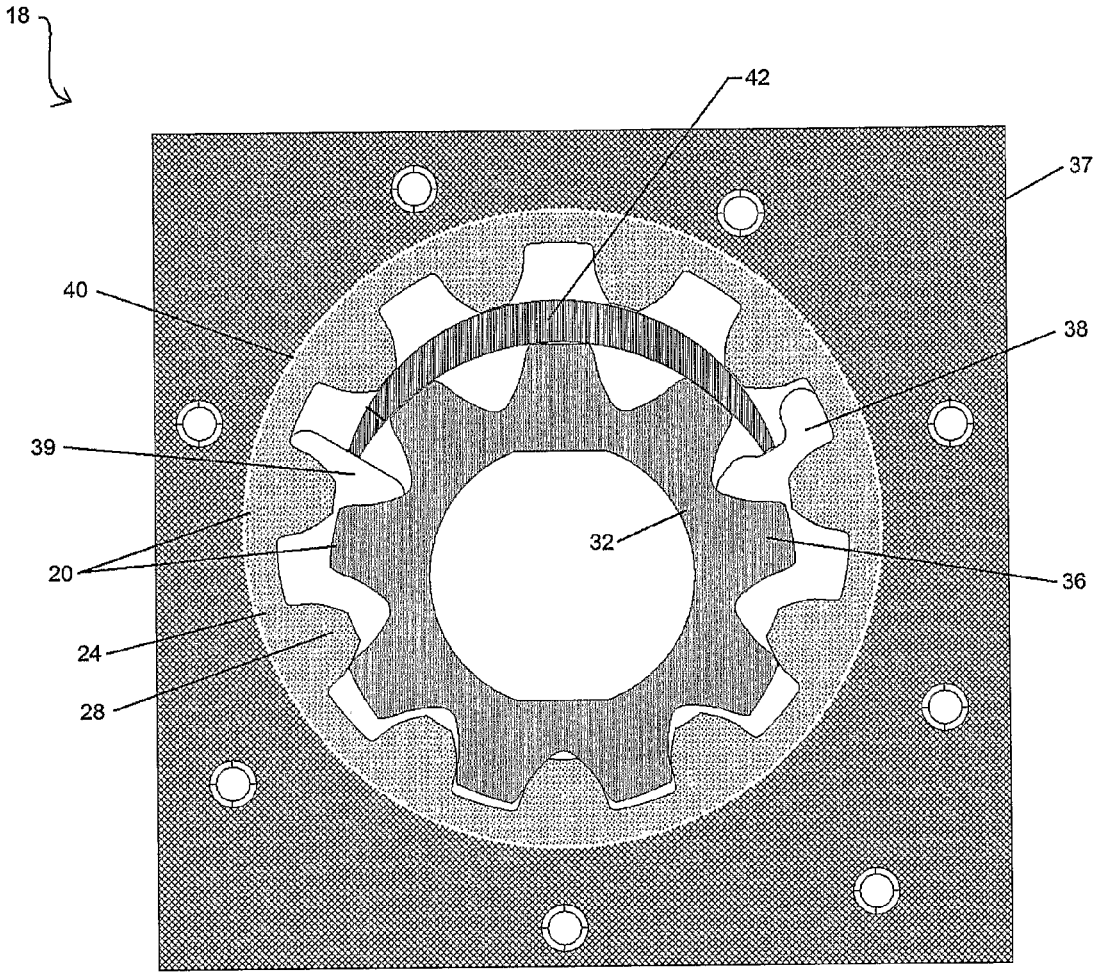
FIG. 1 shows a crescent gear pump with a rotor set in accordance with the present invention.

A crescent gear pump in accordance with the present invention is indicated generally at 18 in FIG. 1. Specifically, pump 18 includes a rotor set 20 with an outer rotor 24 with inwardly extending teeth 28 and an inner rotor 32 with outwardly extending teeth 36.

Pump 18, which employs rotor set 20, includes a housing 37 having an inlet 38 and an outlet 39 which are in fluid communication with a rotor chamber 40 in housing 37. Rotor set 20 is located in housing 37, with a crescent 42 separating the inlet (low pressure) side of rotor chamber 40 from the outlet (high pressure) side of the rotor chamber 40. Inner rotor 32 is rotated by a driveshaft (not shown) extending from housing 37 and, as inner rotor 32 is rotated, it rotates outer rotor 24 via the meshing of teeth 28 and 36.

As will be described in more detail below, the profile of outer rotor teeth 28 is a composite of a truncated offset hypocycloidal arc and a circular arc. Further, the profile of the teeth 36 of inner rotor 32 are preferably generated via outer rotor 24 and thus the profile of inner rotor teeth 36 preferably are generated from the composite-shaped outer rotor teeth 28. However, as will be apparent to those of skill in the art, it is also possible and contemplated by the present inventors to form the profile of teeth 36 of inner rotor 32 to have the desired composite of a truncated offset hypocycloidal arc and a circular arc and to generate the profile of teeth 28 of outer rotor 24 via inner rotor 32. It is also possible and contemplated by the present inventors to design and directly form the profiles of both inner rotor teeth 36 and outer rotor teeth 28 without generating one from the other.

The resulting conjugate action between the respective teeth 28,36 of outer rotor 24 and inner rotor 32 is not limited to the hypocycloidal arc portion of the tooth profiles and, instead, the conjugate action between the respective teeth 28, 36 of outer rotor 24 and inner rotor 32 uses a larger proportion of the tooth depth when meshing. This increases the contact ratio of the rotor set 20 which decreases the operating noise level.

Further, the use of the circular arc with the truncated offset hypocycloidal arc for the tooth profiles of the present invention results in larger tooth gaps in outer rotor 24 which in turn allows rotor set 20 to feature a larger displacement in a given rotor set volume ("package") than prior art designs.

Figure 2:
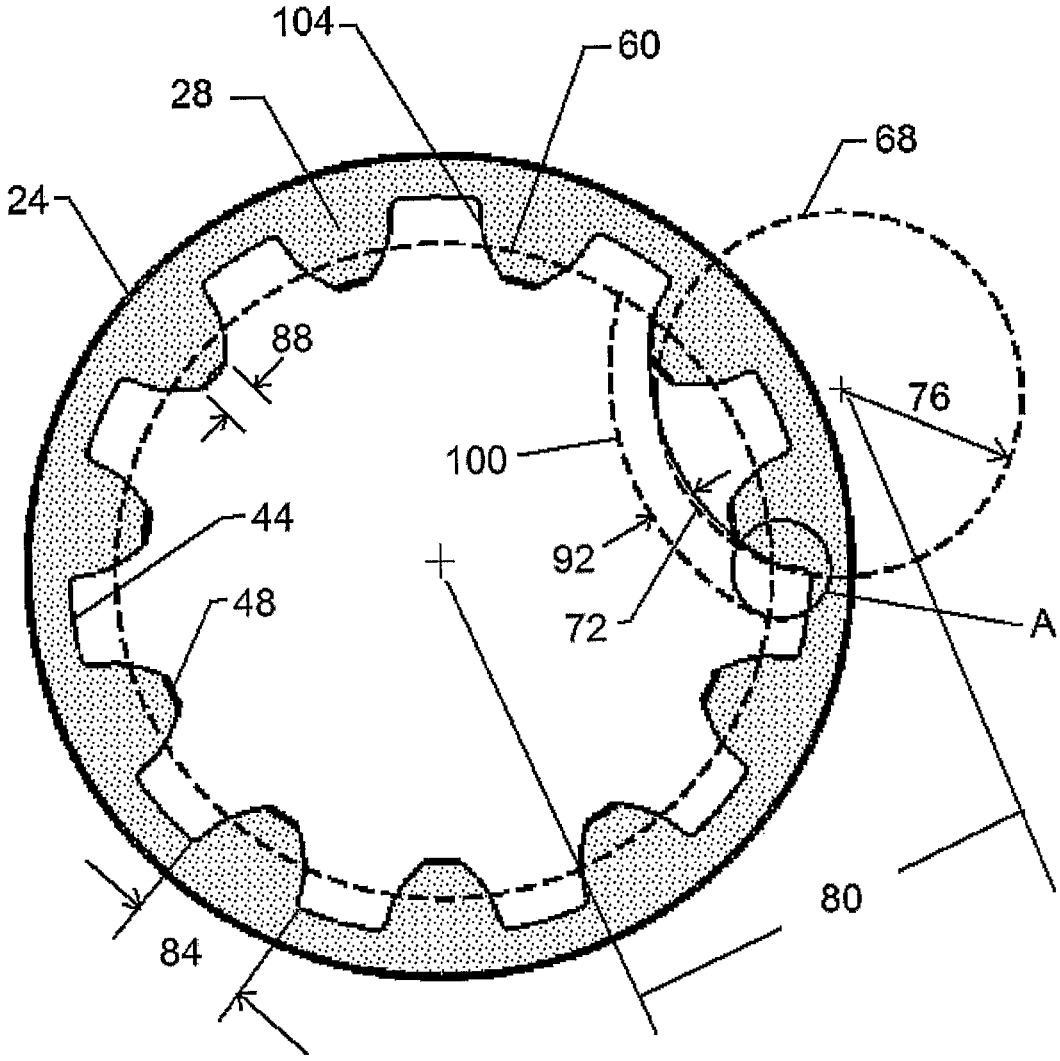
FIG. 2 shows the outer rotor of the rotor set of FIG. 1.
Figure 3:
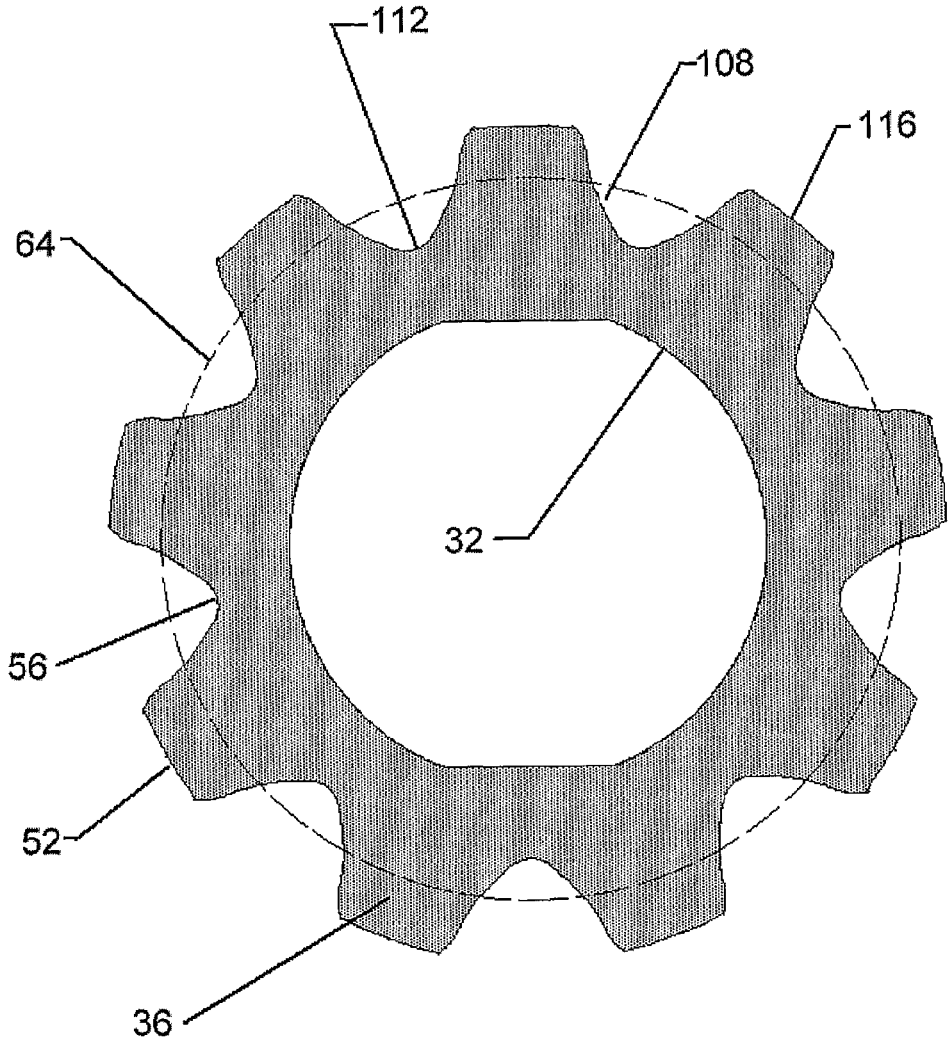
FIG. 3 shows the inner rotor of the rotor set of FIG. 1.

Referring now to FIGS. 2 and 3, the design of rotor set 20 will now be described in more detail. To create rotor set 20, the major diameter 44 and minor diameter 48 of outer rotor 24 are selected and the major diameter 52 and minor diameter 56 of inner rotor 32 are selected and the eccentricity of rotor set 20 is selected based upon the desired displacement and packaging of rotor set 20. The selection of major and minor diameters of rotors 24 and 32 and rotor set eccentricity is performed in accordance with conventional rotor set design criteria well known to those of skill in the art.

In the design criteria, the module (which is a measure of rotor tooth size and is defined as the rotor's pitch diameter divided by the number of teeth of the rotor) for rotor set 20 is set to be equal to the eccentricity which results in the pitch radius 60 of outer rotor 24 being equal to one-half the eccentricity multiplied by the number of teeth 28 of outer rotor 24. Similarly, the pitch radius 64 of inner rotor 32 is equal to one-half the eccentricity multiplied by the number of teeth 36 of inner rotor 32.

As mentioned above, the profile of teeth 28 of outer rotor 24 are defined as a composite of a circular arc 68 and a hypocycloidal arc 72. Specifically, first the radius 76 of circular arc 68 and its center position length 80 from the center of rotor 24 are selected. The selection of radius 76 and center position length 80 is performed by solving a set of equations to achieve a selected ratio between the width of root 84 and the width of tip 88 of a tooth 28, where the ratio is selected to reduce leakage across tip 88.

Next, the distance 92 by which the hypocycloid curve 72 to be used to shape the teeth 28 is offset from the original hypocycloid curve 100 is determined from center position length 80 and radius 76. However, due to the outward offset, hypocycloid curve 72 does not extend to major diameter 44. As will be apparent to those of skill in the art, this is an inherent mathematical characteristic of outwardly offsetting the original hypocycloid curve 100. To close the gap between hypocycloid curve 72 and major diameter 44, radius 76 and center position length 80 are adjusted to create a continuous transition from hypocycloid curve 72 to circular arc 68 extending up to major diameter 44, as indicated in circle A of FIG. 2. The resulting circular arc 68 enables the flank 104 of tooth 28 to be extended to major diameter 44 while maintaining continuity of the profile geometry of tooth 28.

The hypocycloid portion extending inward into minor diameter 48 is then removed, thus keeping only the hypocycloid portion extending from minor diameter 48 to the terminating point of the offset hypocycloid. Next, from the terminating point of the offset hypocycloid to major diameter 44, the portion of the circular arc, defined by circle 68 and center position length 80, is kept while the remaining portion of the circular arc is trimmed/removed. Finally, the minor diameter 44 portion and the major diameter 48 portion are added to complete a half of a tooth 28 for rotor 24.

In creating outer rotor 24, the profile of one side of a tooth 28 can be created and then mirrored to obtain the profile of a complete tooth 28. The remainder of outer rotor 24 can then be obtained by copying and rotating the complete tooth 28 as needed, and as will be apparent to those of skill in the art.

Once outer rotor 24 has been obtained, inner rotor 32 can be generated by any other suitable means as will occur to those of skill in the art. In one embodiment, inner rotor 32 is obtained via rolling inner rotor 32 within outer rotor 24. Specifically, first the conjugate of flank 104 is generated to obtain the profile for driving flank 108. As will be apparent to those of skill in the art, the majority of torque between outer rotor 24 and inner rotor 32 is carried by flanks 104 and 108. Next, a root fillet 112 is appended to the profile of flank 108 and, finally, the major diameter profile 116 is appended to the profile of flank 108. Root fillet 112 is tangent to driving flank 108, thus reducing the stress concentration which is developed in that area during operation of rotor set 20. As will be apparent to those of skill in the art, as the profile of flank 108 is completely conjugate to the flank 104 of outer rotor 24, a smooth transition between driving flank 108 and major diameter profile 116 is not possible. This is a result of driving flank 108 extending beyond the major diameter profile 116, thus requiring the driving flank 108 to be trimmed, resulting in a sharp corner at their interface which is subsequently filleted to reduce stress concentrations which would otherwise result.

As discussed above, a pump comprising a hypocycloidal circular rotor set constructed in accordance with the present invention can achieve a higher displacement (volumetric capacity) than the same pump with a trochoidal rotor set. In a test of the present invention, a crescent gear pump with a rotor set width of 12.584 mm and an eccentricity of 6.9755 mm had a displacement of 20,601 $mm^3$/rev with a trochoidal rotor set and a displacement of 21,166.68 $mm^3$/rev with a hypocycloidal circular rotor set in accordance with the present invention. In addition, operating noise was reduced, as was the level of output pulsations, with the hypocycloidal circular rotor set of the present invention.

The present invention provides a novel crescent gear pump and pump rotor set for a crescent gear pump. The rotor set includes an outer rotor with teeth having a composite profile formed over the portion adjacent their root to conform to a circular arc and formed over the portion adjacent their tip to conform to a hypocycloid arc. The unique shape allows for increased volumetric capacity of the rotor set, when compared to trochoidal rotor sets of the same size. Further, operating noise is reduced, as are pulsations in the output of the pump when compared to the same pump with a trochoidal rotor set.

The above-described embodiments of the invention are intended to be examples of the present invention and alterations and modifications may be effected thereto, by those of skill in the art, without departing from the scope of the invention which is defined solely by the claims appended hereto.

We claim:

1. A crescent gear pump, comprising:

a housing defining a rotor chamber, the housing including a working fluid inlet and a working fluid outlet, each in fluid communication with a portion of the rotor chamber;

a rotor set rotatable within the rotor chamber, the rotor set comprising:

an outer rotor having a first number of inwardly extending teeth;

an inner rotor having a second number of outwardly extending teeth, the second number being at least two less than the first number, the teeth of the inner rotor having a conjugate composite profile of the teeth of the outer rotor; and a crescent inserted between the inner and outer rotors of the rotor set and providing a sealing surface between the teeth thereof to separate the working fluid inlet and working fluid outlet in the rotor chamber, wherein each of said outer rotor teeth has a composite profile which includes a portion adjacent a root of the tooth formed to conform to a circular arc and a portion adjacent a tip of the tooth to conform to a hypocycloid arc.

2. A crescent gear pump as set forth in claim 1, wherein each of said tips has a width and each of said roots has a width and a ratio of the width of said root and the width of said tip is selected to reduce leakage across said tip.

3. A crescent gear pump as set forth in claim 1 wherein the module of the rotor set is equal to an eccentricity of the rotor set.

4. A crescent gear pump as set forth in claim 3 wherein the outer rotor has a pitch radius equal to one-half of the eccentricity multiplied by the first number.

5. A crescent gear pump as set forth in claim 4 wherein the inner rotor has a pitch radius equal to one-half of the eccentricity multiplied by the second number.

6. A crescent gear pump as set forth in claim 1, wherein said composite profile has a continuous transition between said circular arc and said hypocycloid arc.

7. A crescent gear pump as set forth in claim 1, wherein said inner rotor has a root fillet extending between said teeth of said inner rotor.

8. A rotor set for a crescent gear pump, the rotor set comprising:

an outer rotor having a first number of inwardly extending teeth, each outer rotor tooth having a composite profile which includes a portion adjacent the root of the tooth formed to conform to a circular arc and a portion adjacent the tip of the tooth to conform to a hypocycloid arc; and an inner rotor having a second number of outwardly extending teeth, the second number being at least two less than the first number, the teeth of the inner rotor having a conjugate composite profile to the teeth of the outer rotor.

9. A rotor set as set forth in claim 8, wherein each of said tips has a width and each of said roots has a width and a ratio of the width of said root and the width of said tip is selected to reduce leakage across said tip.

10. A rotor set as set forth in claim 8 wherein the rotor set has a module equal to an eccentricity of the rotor set.

11. A rotor set as set forth in claim 10 wherein the outer rotor has a pitch radius equal to one-half of the eccentricity multiplied by the first number.

12. A rotor set as set forth in claim 11 wherein the inner rotor has a pitch radius equal to one-half of the eccentricity multiplied by the second number.

13. A rotor set as set forth in claim 8, wherein said composite profile has a continuous transition between said circular arc and said hypocycloid arc.

14. A rotor set as set forth in claim 8, wherein said inner rotor has a root fillet extending between said teeth of said inner rotor.

* * * * *